US008312647B2

(12) United States Patent
Hofmann

(10) Patent No.: US 8,312,647 B2
(45) Date of Patent: Nov. 20, 2012

(54) SHOE, PARTICULARLY SPORTS SHOE

(75) Inventor: Theodor Hofmann, Schluesselfeld (DE)

(73) Assignee: Puma SE, Herzogenaurach (DE)

( * ) Notice: Subject to any disclaimer, the term of this patent is extended or adjusted under 35 U.S.C. 154(b) by 0 days.

(21) Appl. No.: 13/265,681

(22) PCT Filed: Apr. 1, 2010

(86) PCT No.: PCT/EP2010/002123

§ 371 (c)(1),
(2), (4) Date: Nov. 2, 2011

(87) PCT Pub. No.: WO2010/121709

PCT Pub. Date: Oct. 28, 2010

(65) Prior Publication Data

US 2012/0036735 A1 Feb. 16, 2012

(30) Foreign Application Priority Data

Apr. 24, 2009 (DE) ..... 20 2009 006 111 U

(51) Int. Cl.
*A43B 13/14* (2006.01)
*A43B 13/42* (2006.01)

(52) U.S. Cl. ..... 36/103; 36/76 R; 36/25 R; 36/108

(58) Field of Classification Search ..... 36/103, 36/76 R, 25 R, 108, 61, 27
See application file for complete search history.

(56) References Cited

U.S. PATENT DOCUMENTS

| | | | | |
|---|---|---|---|---|
| 1,931,044 | A * | 10/1933 | Veling et al. | 36/42 |
| 2,176,684 | A * | 10/1939 | Quirk | 36/76 R |
| 3,754,340 | A * | 8/1973 | Pais | 36/42 |
| 6,058,627 | A * | 5/2000 | Violette et al. | 36/61 |
| 7,254,905 | B2 | 8/2007 | Dennison | |
| 2004/0226114 | A1 * | 11/2004 | Karasawa | 12/146 B |
| 2004/0226188 | A1 * | 11/2004 | Lin | 36/2.6 |
| 2006/0021254 | A1 * | 2/2006 | Jones | 36/61 |

FOREIGN PATENT DOCUMENTS

| | | | |
|---|---|---|---|
| DE | 315 919 | C | 11/1919 |
| DE | 693 06 142 | T2 | 4/1997 |
| FR | 449 892 | A | 3/1913 |
| FR | 880 998 | A | 4/1943 |
| GB | 300 797 | A | 11/1928 |

* cited by examiner

*Primary Examiner* — Ted Kavanaugh
(74) *Attorney, Agent, or Firm* — Lucas & Mercanti, LLP

(57) ABSTRACT

The invention relates to a shoe, particularly to a sports shoe, with a sole (1), wherein the sole (1) comprises at least one spring element (2), which spring element increases the bending stiffness of the sole (1) around an axis (Q) which is oriented horizontally and perpendicular to a longitudinal direction (L) of the sole (1). To create a shoe which sole has a sufficient bending stiffness and spring properties respectively without employing separate measures, i. e. without employing a spring element, the invention proposes that the sole comprises at least one receiving groove (3) for the at least one spring element (2), in which the spring element (2) is arranged in such a manner that it can slide at least along a part of its extension in longitudinal direction (L) relatively to the sole (1).

10 Claims, 1 Drawing Sheet

SHOE, PARTICULARLY SPORTS SHOE

This application is a 371 of PCT/EP2010/02123 filed Apr. 1, 2010, which in turn claims the priority of DE 20 2009 006 111.6 filed Apr. 24, 2009, the priority of both applications is hereby claimed and both applications are incorporated by reference herein.

The invention relates to a shoe, particularly to a sports shoe, with a sole, wherein the sole comprises at least one spring element, which spring element increases the bending stiffness of the sole around an axis which is oriented horizontally and perpendicular to a longitudinal direction of the sole.

A shoe of this kind is known e. g. from WO 2008/000398 A1. Here, a shoe is supplied with a stiff insole which has spring properties to increase the bending stiffness of the shoe around a horizontal transverse axis and so to give the shoe the stiffness which is necessary for its use for example as a running shoe. It can be detrimental for such a solution that the handling effort is relatively high if a usual shoe is concerned and not, as in the mentioned document, a shoe which is compressible in a longitudinal direction of the shoe. The inherent stiff insole must namely be inserted into the shoe if required.

It is also known to connect a reinforcement or spring element, which extends into the longitudinal direction of the shoe, firmly with the sole, e. g. by glueing, to increase the bending stiffness around the transverse axis. Here, it is detrimental that significant tensions can be created between the reinforcement or spring element and the shoe sole during initiation of bending moments around the transverse axis and thus of bending deformation around this axis. Thereby, even the danger of braking of the reinforcement or spring element exists.

Thus, it is the object of the invention to further develop a shoe, especially a sports shoe, of the kind mentioned above so that the mentioned problem is prevented. Thus, a shoe should be created which has a sole which has a sufficient bending stiffness and spring property respectively around a horizontal axis which is transverse to the longitudinal axis without separate measures, i, e. without inserting a spring element, by an incorporated spring element, wherein however the spring element is arranged in such a way that also in the case of big bending deformations no danger of breaking is given for the spring element. By doing so it should be achieved that especially in the case of a soccer shoe an increase of the shooting power is possible and so the shot speed can be influenced positively. However, during normal running no undesired high stiffness should be given.

The solution of this object according to the invention is characterized in that the sole comprises at least one receiving groove for the at least one spring element, in which the spring element is arranged in such a manner that it can slide at least along a part of its extension in longitudinal direction relatively to the sole.

The spring element has preferably a strip shape along at least a substantial longitudinal extension, especially along at least 75% of its length measured in longitudinal direction.

The spring element can have at least partially a rectangular form in a section perpendicular to the longitudinal direction.

To ensure that no detraction is given for the wearer of the shoe due to the proposed design the upper side of the spring element and the upper side of the sole preferably form a substantial flush surface.

The spring element can comprise a broadening in horizontal direction transverse to the longitudinal direction at one of its axial ends to facilitate the fixation at the sole. Hereby, the broadening is preferably arranged in the front end region of the spring element. The spring element together with its broadening can have the shape of a T in a top plan view.

The spring element is according to a preferred embodiment of the invention connected with the sole by means of at least one screw connection. Furthermore, a specifically preferred embodiment of the invention proposes that the screw connection simultaneously fixes a cleat at the bottom side of the sole.

Preferably, the spring element consists of plastic material in which reinforcing fibres are incorporated. The reinforcing fibres are mostly glass fibres or carbon fibres.

The preferred application of the invention is a soccer shoe.

In this case the advantage of the proposed shoe is specifically noticeable that namely in the case of the deformation of the shoe sole (by bending around a horizontal transverse axis to the longitudinal axis) energy can be stored in the spring element which then is delivered during a shot of the ball (similar to a catapult). So, the shooting power can be increased and thus the shot speed can be influenced positively.

Beneficially, on the other hand the spring element does nevertheless not cause an additional reinforcement as in the case of pre-known solutions due to the proposed design.

Because the spring element in its receiving groove in the sole can slide relative to the sole along the substantial extension in longitudinal direction, no tensions can thus be created in the spring element during the bending of the sole around a horizontal transverse axis which could be critical with respect to a breaking of the spring element.

Rather, due to the slide movement of the spring element relatively to the ground of the groove in the sole balancing movements take place so that the spring element always brings the same resistance against bending moments around the transverse axis. The resistance moment of the sole including the spring element is thus substantial constant what makes it possible to design the shoe with respect to its bending behaviour around the transverse axis in an easier way.

In the drawing an embodiment of the invention is depicted.

In the figures a sole 1 of a sports shoe is shown which is connected in known manner with a shoe upper which is not depicted. The sole has a form corresponding to the foot of the wearer, i. e. is has a shell shape. The sole 1 made from the usual materials is equipped with a spring element 2 to give the sole 1 an increased bending resistance when it is subjected to a bending moment which acts horizontally and transverse to the longitudinal direction L of the shoe and the sole 1 respectively, i. e. around the axis Q. The impingement of the shoe sole 1 with such a bending moment is typical, when the shoe contacts the ground and rolls up at the ground during a stride.

Figure 1:
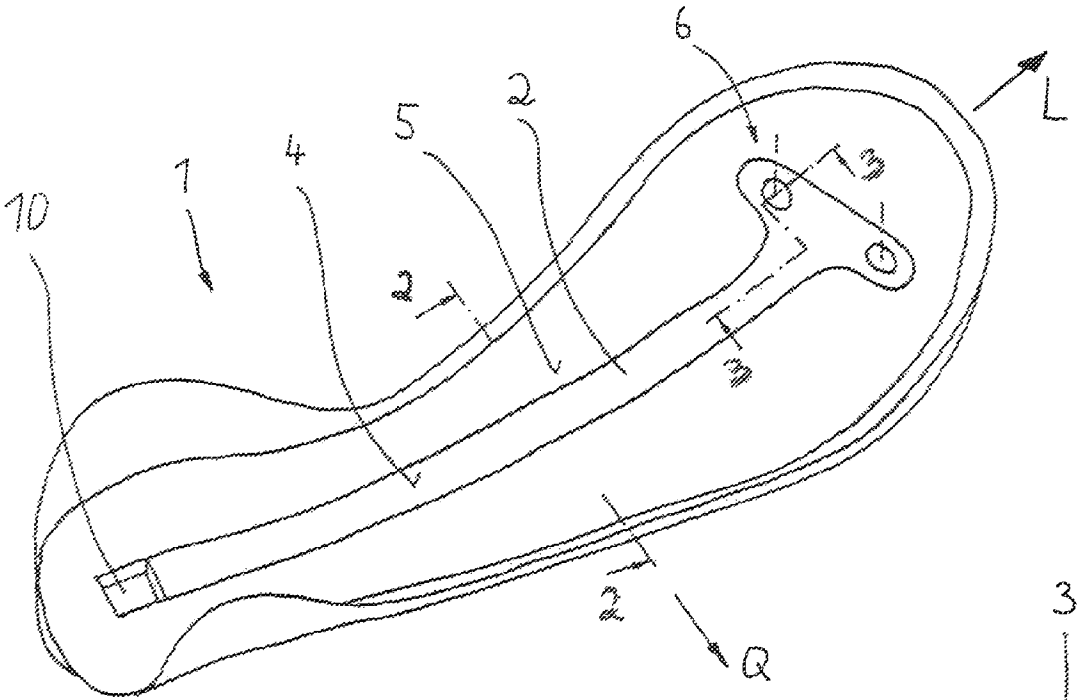
FIG. 1 shows a perspective view of a sole of a sports shoe.
Figure 2:
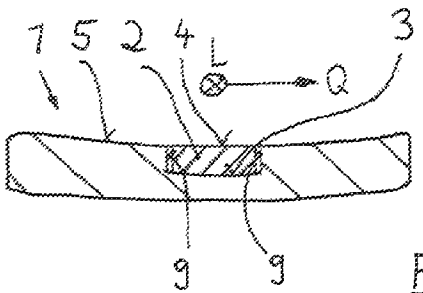
FIG. 2 shows a section perpendicular to the longitudinal direction of the shoe (section A-B in FIG. 1)

Thereby, the spring element 2 is not connected firmly with the sole along its entire extension but is arranged in a receiving groove 3 in the sole 1. As can be seen in FIG. 2 the receiving groove 3 has—just as well as the spring element 2—a substantial rectangular shape in a cross section perpendicular to the longitudinal direction L. Thereby, the spring element 2 is slightly smaller than the width of the receiving groove 3, as can be seen in FIG. 2.

The spring element 2 is firmly connected with the sole 1 in the toe region of the sole, apart from that it lies freely in the receiving groove 3, guided by the lateral faces 9 of the receiving groove 3. If a bending around the axis Q takes place, e. g. during rolling up of the shoe on the ground, the sole 1 and the spring element 2 do not deform uniformly due to the geometrical relationship but slightly different. This difference is equalized by the fact that the spring element 2 slides in the receiving groove 3 in longitudinal direction L. Therefore the receiving groove 3 has in its rear end region a marginal longer extension as it would correspond to the spring element 2, see free space 10.

Preferably, the spring element 2 is (depending on the shoe size) between 15 cm and 28 cm long and has a lamellar section with a rectangular form in the cross section which can have a length between 10 cm and 23 cm. This section having a rectangular cross section has preferably a width between 10 mm and 20 mm and has preferably a height between 1 mm and 4 mm.

As can further be seen, the upper side 4 of the spring element 2 and the upper side 5 of the sole 1 flush so that the wearer of the shoe is not hampered by the spring element 2 which is located in the receiving groove 3.

Figure 3:
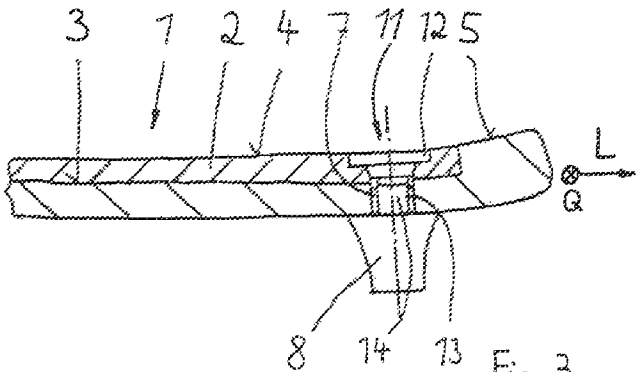
FIG. 3 shows a section through a part of the sole along the longitudinal direction (section C-D according FIG. 1).

The fixation of the spring element 2 takes place—as mentioned—in the toe region of the sole 1. Therefore, the spring element 2 has a broadening 6 in this region so that the spring element 2 has all in all the shape of a T in the top plan view. Presently, two bores are arranged in the spring element 2 in the region of the broadening 6 in which bores a screw sleeve 11 can be inserted from the upper side (see FIG. 3). The screw sleeve 11 has a disk-shaped broadening 12 in the upper region which can be equipped with arbors (not depicted) which pinch into the spring element 2 and thus create a firm assemblage with the same. Downwardly, a screw shaft 13 adjoins to the disk-shaped broadening 12 which is equipped with a thread. The sole 1 has a bore at this location so that the screw shaft 13 can extend till the bottom side of the sole. A cleat 8 is screwed from the bottom side, i. e. the cleat 8 is equipped with a thread section 14 by which it can be screwed into the screw shaft 13.

Beneficially, thereby not only the screw cleat 8 is fixed at the bottom side of the sole, simultaneously the spring element 2 is fixed with the sole 1 in a simple way and with few parts namely exclusively in the toe region of the sole so that the mentioned equilibration function is not affected.

In the case that no cleats are provided the fixation of the spring element 2 with the sole 1 can take place by separate screws which have exclusively the function to fix the spring element 2 at the sole 1.

REFERENCE NUMERALS

1 Sole
2 Spring element
3 Receiving groove
4 Upper side of the spring element
5 Upper side of the sole
6 Broadening
7 Screw connection
8 Cleat
9 Lateral face
10 Free space
11 Screw sleeve
12 Broadening
13 Screw shaft
14 Thread section
L Longitudinal direction
Q Axis

The invention claimed is:

1. A shoe with a sole, wherein the sole comprises at least one spring element, which spring element increases the bending stiffness of the sole around an axis which is oriented horizontally and perpendicular to a longitudinal direction of the sole, wherein the sole has at least one receiving groove for the at least one spring element, the at least one spring element arranged in the at least one receiving groove in such a manner that the at least, one spring element can slide in the longitudinal direction relatively to the sole in the at least one receiving groove, wherein one end of the at least one spring element is firmly connected to the sole, at least 75% of a longitudinal length of the at least one spring element has a strip shape, the receiving groove is in an upper side of the sole so that an upper side of the at least one spring element and the upper side of the sole form a substantially flush surface.

2. The shoe of claim 1, wherein the at least one spring element has at least partially a rectangular form in a section perpendicular to the longitudinal direction.

3. The shoe of claim 1, wherein the at least one spring element comprises a broadening in horizontal direction transverse to the longitudinal direction at one of its axial ends.

4. The shoe of claim 3, wherein the broadening is arranged in a front end region of the at least one spring element.

5. The shoe of claim 3, wherein the at least one spring element together with the broadening has the shape of a T in a top plan view.

6. The shoe of claim 1, wherein the one end of the at least one spring element is firmly connected to the sole by means of at least one screw connection.

7. The shoe of claim 6, wherein the screw connection simultaneously fixes a cleat to a bottom side of the sole.

8. The shoe of claim 1, wherein the at least one spring element consists of a plastic material in which reinforcing fibres are incorporated.

9. The shoe of claim 8, wherein the reinforcing fibres are glass fibres or carbon fibres.

10. The shoe of claim 1, wherein the shoe is a soccer shoe.

* * * * *